US011735042B1

(12) United States Patent
Okezie

(10) Patent No.: US 11,735,042 B1
(45) Date of Patent: Aug. 22, 2023

(54) TRAFFIC WATCH, MONITOR, AND ACCIDENT PREVENTION DEVICE

(71) Applicant: Pathfins C. Okezie, Piscataway, NJ (US)

(72) Inventor: Pathfins C. Okezie, Piscataway, NJ (US)

( * ) Notice: Subject to any disclaimer, the term of this patent is extended or adjusted under 35 U.S.C. 154(b) by 0 days.

(21) Appl. No.: 18/121,095

(22) Filed: Mar. 14, 2023

(51) Int. Cl.

| | |
|---|---|
| ***G08G 1/09*** | (2006.01) |
| ***G08B 25/10*** | (2006.01) |
| ***G08G 1/054*** | (2006.01) |
| ***G08G 1/017*** | (2006.01) |
| ***G08B 7/06*** | (2006.01) |

(52) U.S. Cl.
CPC ..... *G08G 1/09* (2013.01); *G08B 7/06* (2013.01); *G08B 25/10* (2013.01); *G08G 1/0175* (2013.01); *G08G 1/054* (2013.01)

(58) Field of Classification Search
CPC ..... G08G 1/09; G08G 1/0175; G08G 1/054; G08B 7/06; G08B 25/10
See application file for complete search history.

(56) References Cited

U.S. PATENT DOCUMENTS

| | | | | |
|---|---|---|---|---|
| 5,041,828 | A * | 8/1991 | Loeven | G08G 1/0175 340/936 |
| 5,973,618 | A | 10/1999 | Ellis | |
| 6,437,690 | B1 | 8/2002 | Okezie | |
| 6,985,827 | B2 * | 1/2006 | Williams | G01P 3/38 702/143 |
| 7,167,104 | B2 * | 1/2007 | DiPiazza | G08G 1/052 340/936 |
| 7,880,601 | B2 | 2/2011 | Okezie | |
| 8,134,693 | B2 * | 3/2012 | Ciolli | G08G 1/04 356/28 |
| 8,817,100 | B2 * | 8/2014 | Nerayoff | H04N 23/66 348/148 |
| 9,129,540 | B2 * | 9/2015 | Jones | E01F 9/617 |
| 9,940,524 | B2 * | 4/2018 | Krishnamoorthy | G06F 3/0482 |
| 10,229,588 | B2 * | 3/2019 | Che | H04N 7/181 |
| 10,347,107 | B1 | 7/2019 | Okezie | |
| 10,407,853 | B1 * | 9/2019 | Dunn | E01F 13/105 |
| 11,423,749 | B2 * | 8/2022 | Omata | G03B 17/08 |
| 11,600,153 | B1 | 3/2023 | Okezie | |

(Continued)

FOREIGN PATENT DOCUMENTS

KR 20210030060 A 3/2021

*Primary Examiner* — John A Tweel, Jr.
(74) *Attorney, Agent, or Firm* — Walter J. Tencza, Jr.

(57) ABSTRACT

An apparatus including a warning device fixed to a sign, which is configured to be fixed at a location adjacent a road; and wherein the warning device includes: a computer processor; a computer memory; and an audio speaker; and wherein the computer processor is configured to cause a first audio warning to be played on the audio speaker in response to computer programming stored in the computer memory when there is a dangerous road condition. The dangerous road condition may include that a drawbridge has been raised, that there is an icy condition on a bridge, that a vehicle is about to go the wrong way down a one-way street, a sharp curved road, an area is prone to falling rocks, a dangerous intersection, and/or a speed hump. The apparatus may further include a dashboard apparatus, fixed to a vehicle; configured to communicate with the warning device.

18 Claims, 9 Drawing Sheets

(56) References Cited

U.S. PATENT DOCUMENTS

| | | | | |
|---|---|---|---|---|
| 2004/0083031 | A1 | 4/2004 | Okezie | |
| 2004/0145496 | A1 | 7/2004 | Ellis | |
| 2006/0097855 | A1 | 5/2006 | Turnbull | |
| 2008/0103655 | A1 | 5/2008 | Turnbull | |
| 2009/0289443 | A1 | 11/2009 | Okezie | |
| 2014/0046800 | A1 | 2/2014 | Chen | |
| 2015/0127215 | A1 | 5/2015 | Chatterjee | |
| 2015/0160019 | A1 | 6/2015 | Biswal | |
| 2015/0258431 | A1 | 9/2015 | Stafford | |
| 2015/0351681 | A1 | 12/2015 | Lee | |
| 2016/0039424 | A1 | 2/2016 | Hong | |
| 2017/0155997 | A1 | 6/2017 | Boesen | |
| 2017/0188077 | A1 | 6/2017 | Cansino | |
| 2017/0323569 | A1* | 11/2017 | Willborn | G08G 1/096758 |
| 2018/0279032 | A1 | 9/2018 | Boesen | |
| 2019/0035267 | A1* | 1/2019 | Balzer | G08G 1/017 |
| 2019/0370562 | A1 | 12/2019 | Yigit | |
| 2020/0111352 | A1 | 4/2020 | Openiano | |
| 2020/0130569 | A1 | 4/2020 | Lindsey | |
| 2020/0189476 | A1 | 6/2020 | Consolacion | |
| 2021/0101483 | A1 | 4/2021 | Okezie | |

* cited by examiner

TRAFFIC WATCH, MONITOR, AND ACCIDENT PREVENTION DEVICE

FIELD OF THE INVENTION

This invention relates to devices for monitoring traffic and preventing accidents.

BACKGROUND OF THE INVENTION

There are various types of traffic accidents that occur.

For example, a first type of traffic accident relates to drivers driving the wrong way on a one-way road and/or disobeying a "do not enter" sign. Sometimes a vehicle operator accidentally or unintentionally drives the wrong way down a one way street or does not notice a "do not enter" sign. Other times, a vehicle operator intentionally and blatantly disregards one way street signs or "do not enter" signs.

Whether intentional or not, driving the wrong way can result in a head-on collision and even in fatalities. The frequency of this type of traffic violation is on the rise.

Another type of traffic accident relates to bridges and particularly drawbridges. There are about eight hundred and one drawbridges around the world. Suspension bridge and/or drawbridge related traffic accidents are much more common than is realized by the general public.

Better safety devices or mechanisms are needed to alert vehicles, pedestrians, cyclists and motorcyclists approaching any draw/suspension bridge on both sides of the bridges, as to whether a drawbridge has been raised or whether there is some other dangerous condition on the bridge.

The number of traffic accidents on drawbridges and/or suspension bridges, both locally and internationally, is disturbing. For instance, in India, on Oct. 30, 2022, a suspension bridge collapsed and about one hundred and thirty-four people died.

On Dec. 25, 2005, in the State of New Jersey, U.S.A., two police officers were on duty trying to cross a drawbridge over the Hackensack river when the drawbridge suddenly opened and their police vehicle fell into the Hackensack river and the two police officers died.

On Aug. 15, 2022, in Milwaukee, Wis., U.S.A., a seventy-seven year-old retiree walking across a drawbridge, died when the drawbridge unexpectedly opened beneath him.

There needs to be better mechanisms to inform and alert the general public, motorists, pedestrians, cyclists, and motorcyclists ahead of time (at least five minutes in advance) prior to the opening or raising of a drawbridge or generally providing notice of a dangerous condition on a bridge.

Frozen bridges are also the cause of many traffic accidents. There are more than 617,000 bridges in the United States, and most of these bridges have surfaces which freeze much faster than non-bridge roads. Snow and ice on the bridge surfaces reduce pavement friction and vehicle maneuverability, causing slower speeds, reduced road visibility and increase crash risk. An average of 1,836 deaths and 136,309 injuries per year are due to snowy and icy roads and bridges.

Another type of traffic accident that is very common relates to sharp curves in a road. A head on collision with another vehicle coming from the opposite side of the road may occur, particularly when a motorist illegally attempts to overtake another vehicle on a sharp curve.

Another type of traffic accident, is an accident related to falling rocks.

Another type of traffic accident relates to dangerous intersections. About 40% of all motor vehicle accidents occur at dangerous intersections.

Speed bumps save lives, but the average cost to motorists resulting from the damages to their vehicles from speed bumps may be anywhere from $500 to $1,500 annually. Damages from speed bumps may include misalignment of a vehicle wheels, causing vehicle fluid leaks, and damage to a vehicle's air conditioning systems.

SUMMARY OF THE INVENTION

One or more embodiments of the present invention are configured to solve the problem of drivers driving the wrong way down a one-way street and/or disregarding a "do not enter" sign.

One or more embodiments of the present invention are configured to provide warnings to pedestrians, motorcyclists, and motorists about any upcoming dangers on drawbridges, suspension bridges, and bridges in general.

One or more embodiments of the present invention are configured to provide an alert of a snowy or icy condition on a bridge.

One or more embodiments of the present invention provide a warning when there is a sharp curve in the road not to attempt to overtake another vehicle.

In at least one embodiment, a rock falling warning device is provided.

In at least one embodiment, a dangerous intersection warning device is provided.

One or more embodiments of the present invention provide a speed bump warning device.

In at least one embodiment an apparatus is provided comprising: a warning device fixed to a sign, which is configured to be fixed at a location adjacent a road; and wherein the warning device includes: a computer processor; a computer memory; and an audio speaker; and wherein the computer processor is configured to cause a first audio warning to be played on the audio speaker in response to computer programming stored in the computer memory when there is a dangerous road condition.

In at least one embodiment, the dangerous road condition may include that a drawbridge has been raised, that there is an icy condition on a bridge, and/or that a vehicle is about to go the wrong way down a one way street. The dangerous road condition may also include that a sharp curve in a road, an area prone to falling rocks, a dangerous intersection, and/or a speed hump located on a road.

The apparatus may further include a dashboard apparatus, configured to be fixed to a vehicle; wherein the dashboard apparatus is configured to communicate wirelessly with the warning device concerning the dangerous road condition. The warning device may further include a computer display; wherein the computer processor is configured to cause a first visual warning to be displayed on the computer display in response to computer programming stored in the computer memory when there is a dangerous road condition.

In at least one embodiment, a method is provided which may include fixing a warning device which is fixed to a sign, at a location adjacent a road; and wherein the warning device includes: a computer processor; a computer memory; and an audio speaker; wherein the computer processor is configured to cause a first audio warning to be played on the audio speaker in response to computer programming stored in the computer memory when there is a dangerous road condition, wherein the dangerous road condition may be as previously specified.

The method may further include fixing a dashboard apparatus to a vehicle; wherein the dashboard apparatus is configured to communicate wirelessly with the warning device concerning the dangerous road condition.

DETAILED DESCRIPTION OF THE DRAWINGS

Figure 1:
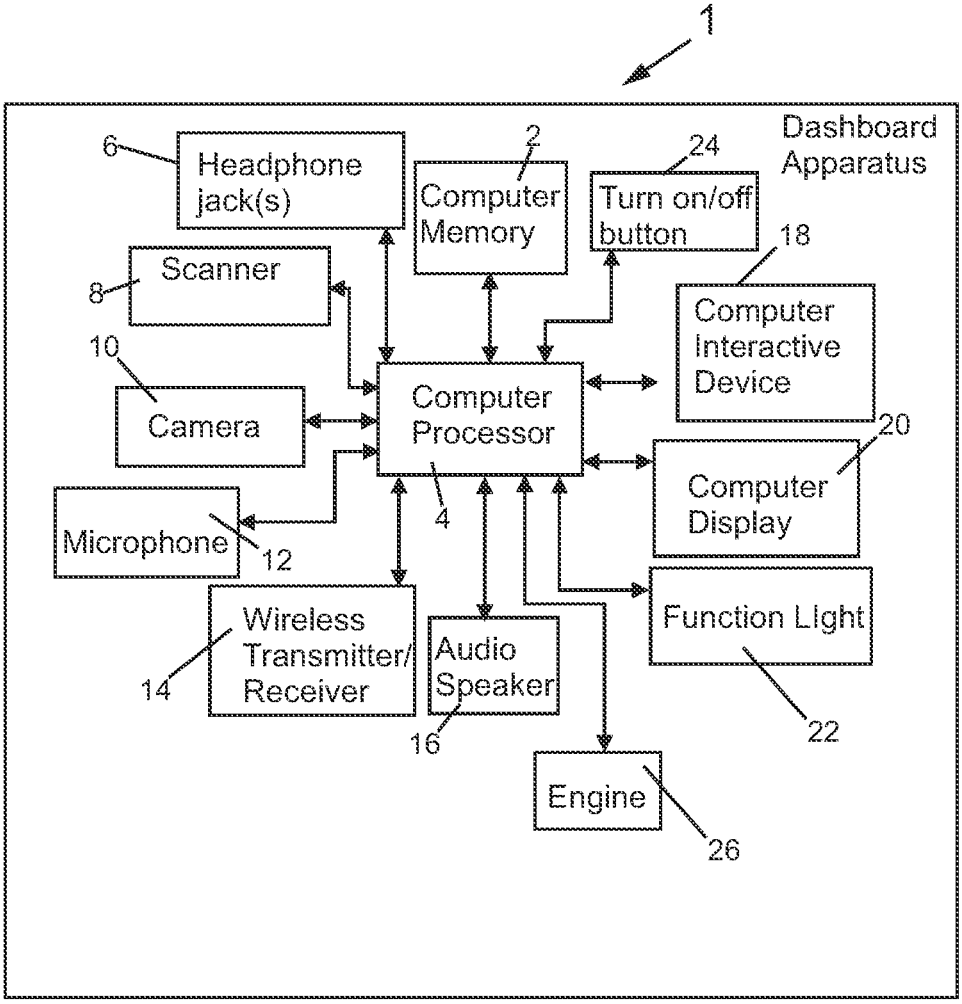
FIG. 1 shows a simplified block diagram of a dashboard apparatus configured to be fixed to a vehicle, such as an automobile, in accordance with an embodiment of the present invention.

FIG. 1 shows a simplified diagram of a dashboard apparatus 1 configured to be fixed to a vehicle, such as an automobile, in accordance with an embodiment of the present invention.

The dashboard apparatus 1 includes a computer memory 2, a computer processor 4, one or more headphone jack(s) or port(s) 6, a scanner 8, a camera 10, a microphone 12, a wireless transmitter/receiver 14, an audio speaker 16, a computer interactive device 18, a computer display 20, and a function light 22. The components 2, 6, 8, 10, 12, 14, 16, 18, 20, and 22 communicate with the computer processor 4, such as through hardwired, optical, wireless, and/or other known, preferably bidirectional communications links.

One or more embodiments of the present invention are configured to solve the problem of drivers driving the wrong way down a one-way street and/or disregarding a "do not enter" sign.

The scanner 8, camera 10, and/or wireless transmitter/receiver 14 may receive data, such as visual, audio, infrared, wireless, and/or other data, which may then be processed by the computer processor 4 and/or stored in the computer memory 2.

The data received by one or more of scanner 8, camera 10, and/or wireless transmitter/receiver 14 may include one or more signals received from a "do not enter" or "one way" sign or stand, or as a result of scanning an image of a "do not enter" or "one way sign". The data may be scanned and/or received by the dashboard apparatus 1 in a manner similar to scanning done by dashboard apparatus 100 and/or the scanner 118 disclosed in U.S. Pat. No. 11,600,153, issued Mar. 7, 2023, which is incorporated by reference herein.

Figure 2:
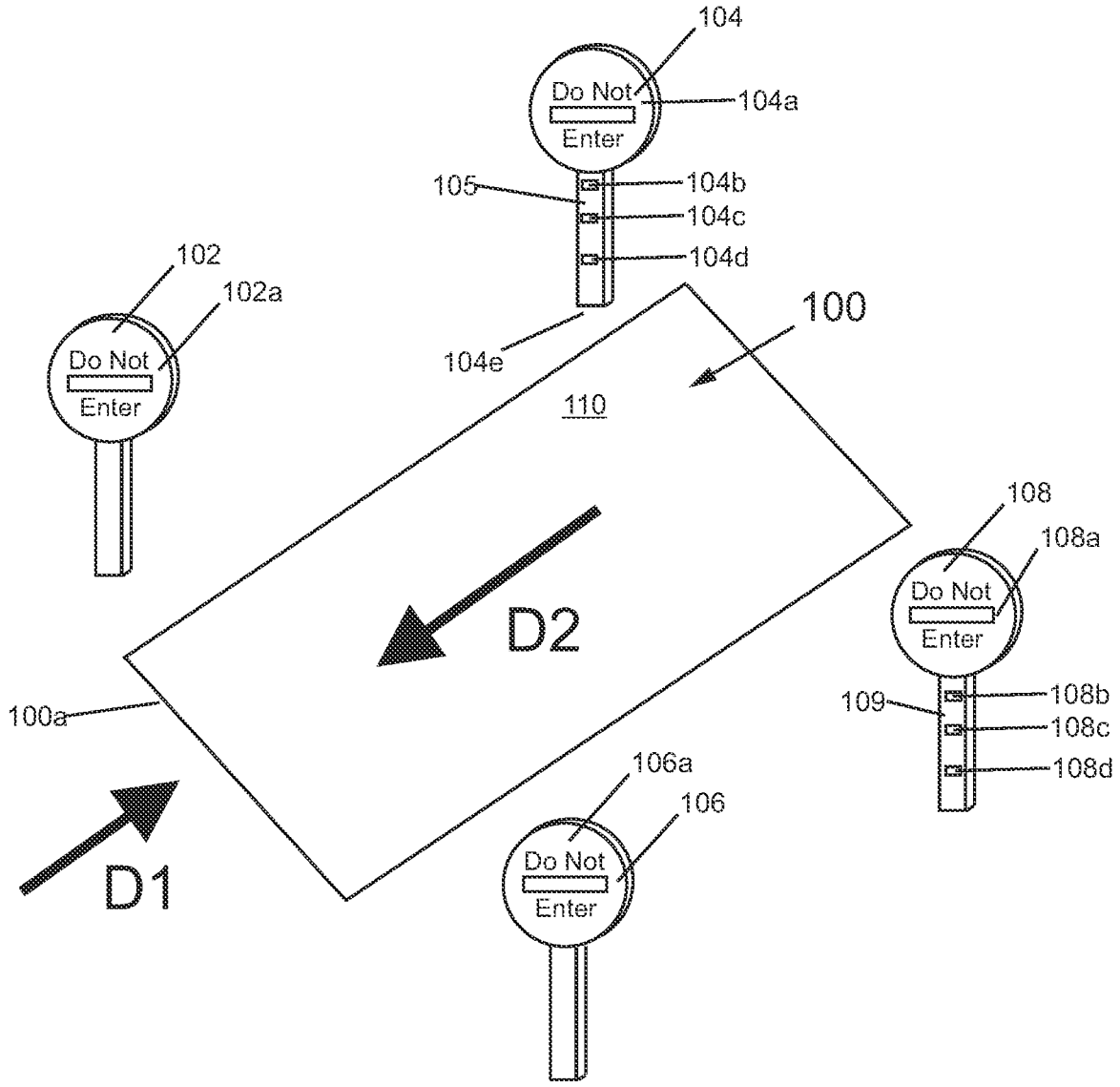
FIG. 2 shows a simplified diagram of a one way street, along with four "do not enter" signs.

FIG. 2 shows a simplified diagram of a one way street 100, along with "do not enter" signs 102, 104, 106, and 108. One or more of the "do not enter" signs 102, 104, 106 and/or 108, may be or may be replaced by "one way" signs.

Each of the signs 102, 104, 106, and/or 108 may be marked with "one way", "wrong way", or "do not enter" language or indicia. It is preferred that there are two signs (102 and 106) at the entrance 100*a* of the street 100 and then two signs spaced apart from those signs (104 and 108) on either side of the street 100, further down the street 100.

The direction D2 is the direction traffic should be moving in, along the street 100, while the direction D1 is the wrong way, and a car or other vehicle entering the street 100 at entrance 100*a* in the direction D1 is going the wrong way down street 100.

The signs 102, 104, 106, 108 may include portions 102*a*, 104*a*, 106*a*, 108*a* which may be marked in bold red colors, or may include flashing lights or which may flash the message "do not enter", "one way", or "wrong way", in an electronic sign form.

Figure 3:
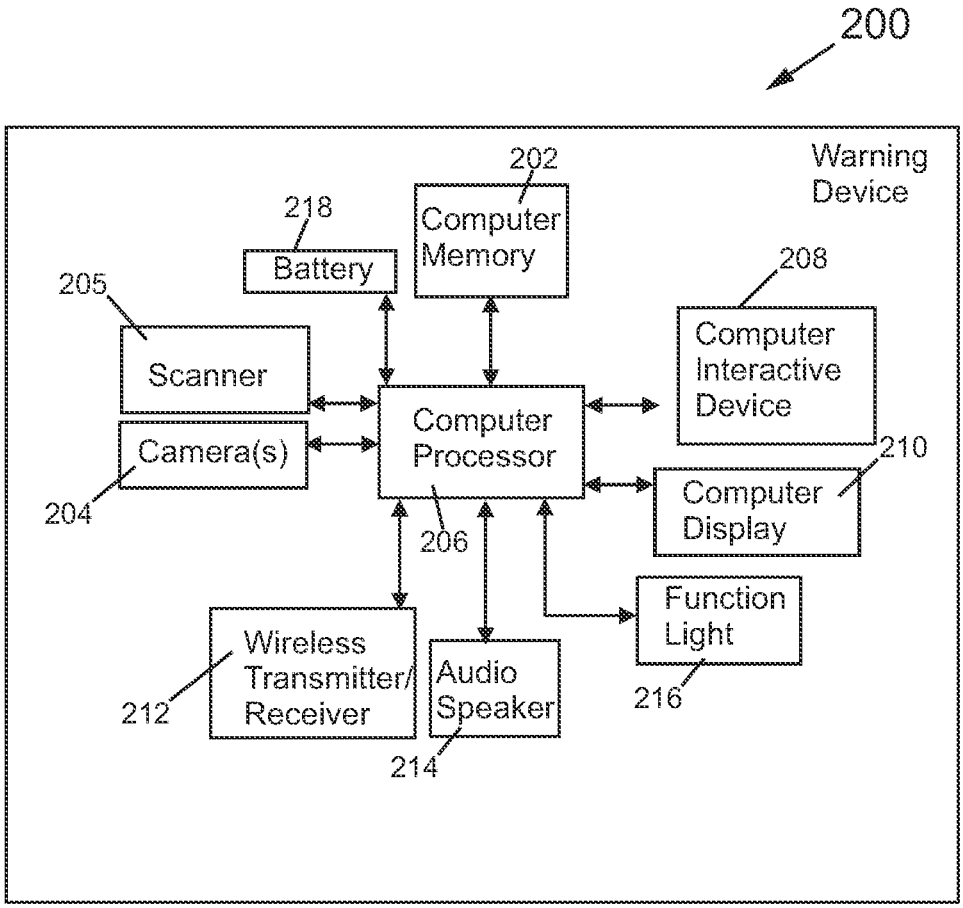
FIG. 3 shows a simplified block diagram of a warning device, which may be placed at various locations to warn of dangerous road conditions.

Each of the portions 102*a*, 104*a*, 106*a* and 108*a* may include or have attached thereto one or more components of warning device 200 shown in a simplified form in FIG. 3.

In at least one embodiment, warning device 200 includes computer memory 202, camera(s) 204, scanner 205, computer processor 206, computer interactive device 208, computer display 210, wireless transmitter/receiver 212, audio speaker 214, a function light 216, and a battery 218. The computer processor 206 is configured to communicate with the components 202, 204, 205, 208, 210, 212, and 214 through one or more communications links such as hardwired, optical, wireless, or any other known communications links.

In at least one embodiment, the warning device 200 may be charged and the function light 216 may have a green lit color when fully charged, a yellow lit color when partially charged, and a red color that alerts the user that it is time to replace or recharge the battery 218 of the warning device 200.

The camera(s) 204 and/or the wireless transmitter/receiver 212 may receive data or one or more signals to determine that an automobile is about to enter the road 100 going the wrong way, or is going the wrong way on the road 100, and the computer processor 206 is configured to process these signals and/or data and store them in the computer memory 202. The computer processor 206 may cause a warning audio message to be played by audio speaker 214 in response to data and/or signals indicating that a vehicle is about to or is travelling the wrong way down street 100. The warning audio message may be stored in computer memory 202. The computer processor 206 may act in accordance with computer programming stored in the computer memory 202. The computer processor 206 may additionally or alternatively, cause a visual warning, such as a blinking red light, or "Wrong Way" language message to be displayed on the computer display 210 in response to signals and/or data indicating a vehicle is about to enter the road or street 100 going the wrong way, or is currently going the wrong way. The computer interactive device 208 may allow a technician to reset and/or provide parameters for one or more components of the warning device 200.

The camera(s) 204 may include one or more camera(s).

In one or more embodiments, the components of the warning device 200 may be located in any part of the signs

102, 104, 106, and 108, and not just the portions 102*a*, 104*a*, 106*a*, and 108*a*. For example, components may be located in the post 105 of the sign 104, shown in FIG. 2.

The wireless transmitter/receiver 212 of the warning device 200 shown in FIG. 3, is configured to transmit one or more signals which are received by the wireless transmitter/receiver 14 of the dashboard apparatus 1, or which may be scanned (and thus received) by the scanner 8 of the dashboard apparatus 1, when a vehicle or automobile (that includes the dashboard apparatus 1) is driving in the direction D1, just before entering the street 100 at entrance 100*a*.

The computer memory 2 of the dashboard apparatus 1 may include computer software and/or programming which causes the computer processor 4 to respond to the sensing of a signal or signals due to the signs 102 and 106, by playing a pre-recorded audio message through the audio speaker 16, that the vehicle (which includes apparatus 1) is about to go the wrong way on a one-way street. The computer processor 4 may also receive video from the camera 10 to determine that the signs 102 and 106 are "do not enter" or "one way" signs, and the computer processor 4 may be programmed by computer memory 2 to send out the same or similar pre-recorded audio message through audio speaker 16 in response to such video.

The audio message may state words to the effect of: "You are about to go the wrong way on a one-way street" and/or "It is against the law for any vehicle operator/driver to knowingly or unknowingly drive through a do not enter sign or go the wrong way on a one way street. You are advised to immediately back up or make a u-turn to prevent a head on collision with an oncoming vehicle." If the particular vehicle operator has common sense, the vehicle operator will stop his/her vehicle, and not enter the one-way street 100, after hearing the audio message from audio speaker 16.

Sometimes the vehicle being operated may be a stolen vehicle, and the illegal vehicle operator may not care whether he/she is driving on a one-way street. Alternatively, it may be that the vehicle operator is drunk or distracted. For these and other reasons, a vehicle operator may continue to drive the wrong way on a one-way street even after visual and/or audio warnings, such as provided by signs 102 and 106 at the entrance 100*a* of the street 100.

For at least these reasons, a second layer of signs is provided, which includes signs 104 and 108, further down the street 100. The signs 104 and 108 also include visual marking or indicia stating "one way" or "wrong way" or "do not enter". Each of the signs 104 and 108 also include one or more components of the warning device 200 shown in FIG. 3. The distance between the first layer of signs (i.e. signs 102 and 106) at the entrance 100*a* and the second layer of signs (i.e. signs 104 and 108) further down the street 100 may be about one and one half car lengths or about twenty-one feet.

Attached to the sign 104, such as, at least in one embodiment to the post 105 of the sign 104 may be devices 104*b*, 104*c*, and 104*d*. The device 104*b* may be a camera, which in at least one embodiment, is one of the camera(s) 204 referred to in FIG. 3. The device 104*c* may be a remote control deactivation device, which in at least one embodiment may include components of the warning device 200, including, at least, the computer memory 202, the computer processor 206, and the wireless transmitter/receiver 212. The device 104*d* may be another camera, which may be one of the camera(s) 204 referred to in FIG. 3.

In at least one embodiment, the camera 104*b* is placed at a height so that it is configured to take a photograph of a person driving a vehicle, such as for example, at a height of a range of about four to five feet, or about eye level of an average sized person. The camera 104*d*, in contrast, is placed at a lower height than the camera 104*b* so that it is configured to take a photograph of a license plate of a vehicle. For example, the camera 104*d* may be at a height of a range of about one to two feet off of a ground surface 110 (or at about ankle level), of the street 100, just below, and adjacent to the bottom 104*e* of the sign 104.

The device 104*c* and/or the wireless transmitter/receiver 212, in response to control by the computer processor 206 as determined by computer software stored in computer memory 202, is configured to transmit one or more signals which are received by the wireless transmitter/receiver 14 of the dashboard apparatus 1, to cause the computer processor 4 of the dashboard apparatus 1 to shut off the vehicle engine 26, as programmed by computer programming stored in computer memory 2. The one or more signals may be sent by the device 104*c* (including wireless transmitter/receiver 212) when the vehicle is within about two feet of the second layer of signs or stands (signs 104 and 108).

In at least one embodiment, the device 104*c* (including wireless transmitter/receiver 212) for deactivating the engine 26 of the approaching vehicle may be placed on top of a small table next to the camera 104*b* and/or the camera 104*d* (of the camera(s) 204).

The devices 104*b*, 104*c*, and 104*d* are configured to be waterproof and are configured to be secure against tampering, destruction, or vandalism.

Figure 4:
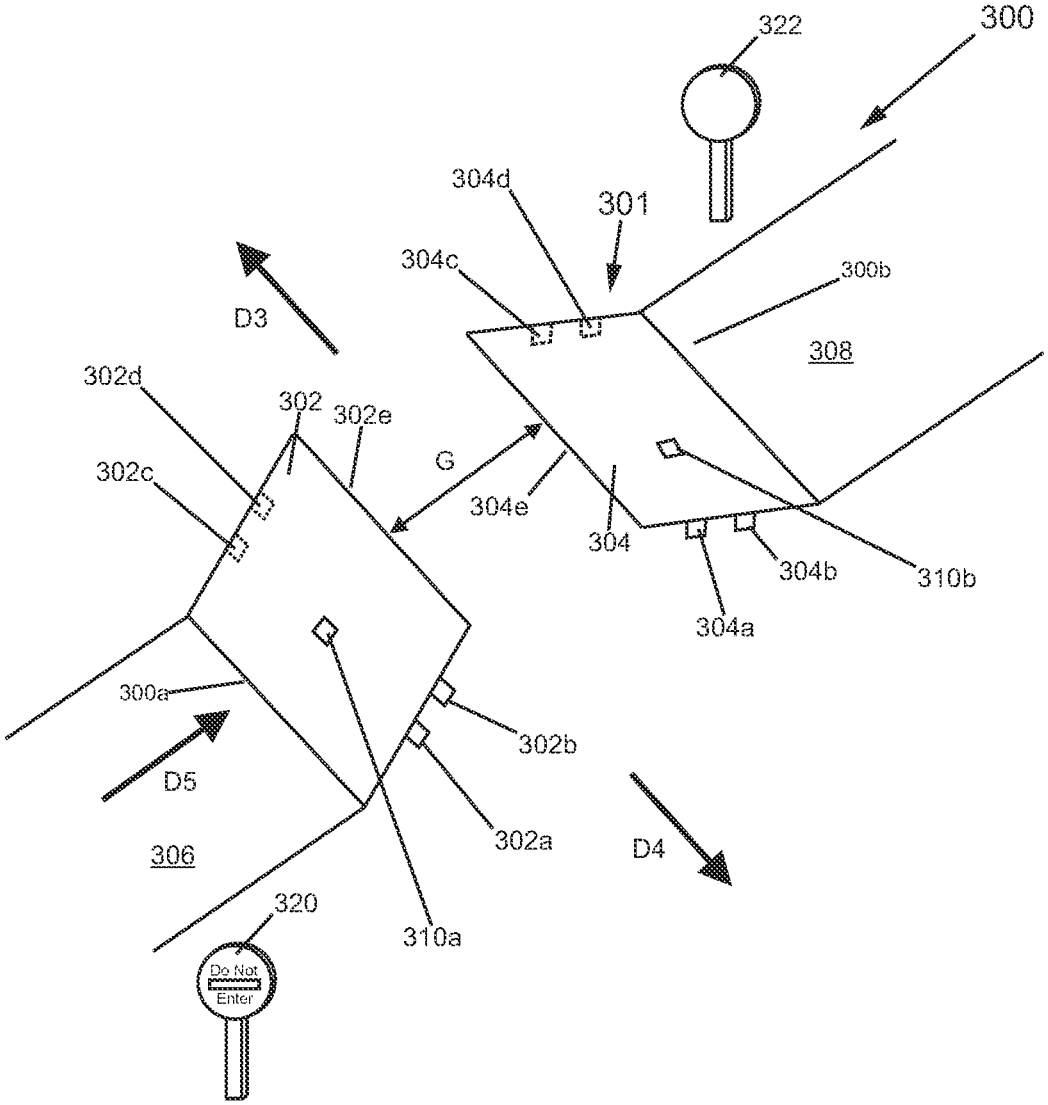
FIG. 4 shows a simplified diagram of an apparatus providing safety features for a drawbridge.

FIG. 4 shows an apparatus 300 providing safety features for bridges, such as suspension bridges, and in particular drawbridges.

The apparatus 300 includes drawbridge 301. The drawbridge is comprised of sections 302 and 304. Each of the sections 302 and 304 can be rotated or raised from a flat position parallel or substantially parallel to road or stationary bridge sections 306 and 308 to an angled position, which is at an angle to road or bridge sections 306 and 308, such as at a forty-five to ninety degree angle with respect to stationary sections 306 and 308. There is a gap G or distance between edges 302*e* and 304*e* of the sections 302 and 304, respectively, introduced by the raising of the bridge sections 302 and 304.

Attached to the bridge section 302, preferably underneath the bridge section 302 are sensors 302*a* and 302*c*, and cameras 302*b* and 302*d*. The sensor 302*c* and camera 302*d* are shown in dashed lines, because they would not be visible but rather blocked by section 302. The sensor 302*a* and camera 302*b* are focused and/or directed towards the direction D4, while the sensor 302*c* and the camera 302*d* are focused and/or directed towards the direction D3. The direction D4 may be upstream or downstream along a river or stream, while the direction D3 would be opposite the direction D4.

Similarly, or identically to bridge section 302, attached to the bridge section 304, preferably underneath the bridge section 304, are sensors 304*a* and 304*c*, and cameras 304*b* and 304*d*. The sensor 304*c* and camera 304*d* are shown in dashed lines, because they would not be visible but rather blocked by section 304. The sensor 304*a* and camera 304*b* are focused and/or directed towards the direction D4, while the sensor 304*c* and the camera 304*d* are focused and/or directed towards the direction D3. The direction D4 may be upstream or downstream along a river or stream, while the direction D3 would be opposite the direction D4.

The sensors 302*a* and 304*a* and the cameras 302*b* and 304*b* are directed in the direction D4 to detect watercraft, such as boats and yachts approaching from that direction towards the bridge apparatus 300 (i.e. travelling in a direction D3, from the direction D4, towards the bridge apparatus 300).

Similarly, or identically, the sensors 302*c* and 304*c* and the cameras 302*d* and 304*d* are directed in the direction D3 to detect watercraft, such as boats and yachts approaching towards the bridge apparatus 300 (i.e. travelling in a direction D4, from the direction D3, towards the bridge apparatus 300).

Each of the sensors 302*a*, 304*a*, 302*c*, 304*c*, and the cameras 302*b*, 304*b*, 302*d*, and 304*d*, include wireless transmitter/receivers, which transmit one or more signals with information concerning a watercraft which is approaching the bridge apparatus 300, and these signals may be received by the dashboard apparatus 1 shown in FIG. 1, such as by wireless transmitter/receiver 14. In at least some embodiments, each of 302*a*, 304*a*, 302*c*, 304*c*, 302*b*, 304*b*, 302*d*, and 304*d* may have some or all of the components of the warning device 200 shown in FIG. 3. In response to warning signals or data from any of the sensors 302*a*, 304*a*, 302*c*, 304*c*, and the cameras 302*b*, 304*b*, 302*d*, and 304*d*, the computer processor 4, in accordance with computer software stored in computer memory 2, may cause an audio message to be played on audio speaker 16 which indicates that there is a dangerous condition, such as that the bridge sections 302 and 304 are in a raised state as in FIG. 4.

Figure 5:
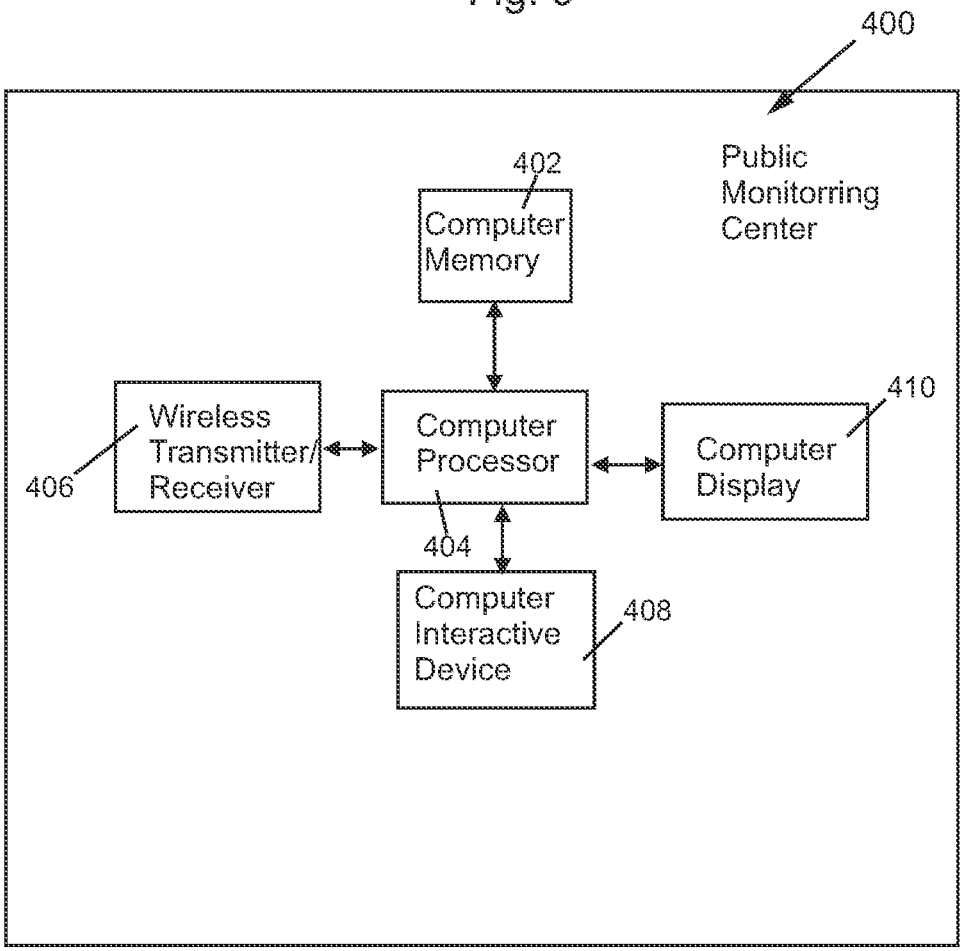
FIG. 5 shows a block diagram of components of a public monitoring center.

In at least one embodiment, the sensors 302, 304*a*, 302*c*, and 304*c* and the cameras 302*b*, 304*b*, 302*d*, and 304*d* are configured to provide one or more signals to a public monitoring center or station 400 shown in FIG. 5. The public monitoring center 400 may include a computer processor 404, a computer memory 402, a wireless transmitter/receiver 406, a computer interactive device 408, and a computer display 410. The computer processor 404 communicates with the components 402, 406, 408, and 410 via known communications links, such as hardwired, optical, wireless, or any other known communications links. The signals provided from 302, 304*a*, 302*c*, and 304*c* and the cameras 302*b*, 304*b*, 302*d*, and 304*d* may indicate the approach of a watercraft, such as a boat or yacht, moving towards the bridge apparatus 300.

Electronic signs 320 and 322 may be provided at the entrance of 300*a* and at the entrance 300*b*, before the open or raised sections 302 and 304, respectively. Typically the signs 320 and 322 are provided on the right side of a road for roads in the United States. Each of the signs 320 and 322 may include one or more of the components of the warning device 200 shown in FIG. 3. For example, each of the signs or stands 320 and 322 may have an electronic and/or digital display, such as computer display 210, which the computer processor 206 causes to display "do not enter" or "stop", in response to computer programming stored in the computer memory 202, when the section 302 is in a raised state as in FIG. 4, to alert or warn approaching vehicles, pedestrians, cyclists and motorcyclists, that the bridge sections 302 and 304 are in a raised state.

Each of the sensors 302*a*, 304*a*, 302*c*, and 304*c* and the cameras 302*b*, 304*b*, 302*d*, and 304*d*, in at least one embodiment, is equipped with a timer, that for example, may be implemented by computer processor 206, in accordance with computer programing stored in the computer memory 202, that is able to calculate the approximate time it will take a ship a yacht to reach the drawbridge apparatus 301 from a particular location.

In at least one embodiment, in accordance with computer programming stored in the computer memory 202, five minutes before a ship or a yacht reaches the draw bridge apparatus 301, a prerecorded message will be played, by the computer processor 206 through audio speaker 214 on each of the signs 320 and 322 to the effect of: "This is a safety warning for all the users of the drawbridge that a ship or a yacht is approaching to cross or pass through the drawbridge at this time." Each of signs 320 and 322 may also include a display, which may be computer display, wherein the computer processor 206 is configured to show video of the particular ship or yacht as it passes through the drawbridge gap G, as programmed by computer programming stored in the computer processor 206.

The audio message may also state through a speaker 214 of each of signs 320 and 322 a message such as "Is strictly recommended that all users of the draw bridge do not enter or attempt to use the draw bridge while the ship or yacht is passing through the draw bridge because it is not safe to do so. You will be advised when it is safe again to use the draw bridge as soon as the ship or yacht has completely passed through the draw bridge and the drawbridge is safely closed again."

In at least one embodiment, an approaching vehicle/s with the dashboard apparatus 1 of the present application on the vehicle is configured to scan the signs 320 and/or 322 to provide a similar audio message through the audio speaker 16 of FIG. 1.

In at least one embodiment, one or more stationary stands or signs may be located at the entrances of both sides of the drawbridge (such as for example both east and west ends, for a east-west bridge, or both north and sound ends for a north-south bridge) as stationary stands, such as stands or signs 320 and 322 in FIG. 4.

The signs 320 and 322 may each have two cameras, such as part of camera(s) 204 with a timer, such as implemented by computer processor 206 as programmed by computer software in computer memory 202. Each of the two cameras may provide information to different public monitoring center, such as similar or identical to public monitoring center 400 in FIG. 5, located in a nearby office. The function of these cameras, on each of signs 320 and 322, in at least one embodiment, is to monitor and catch pedestrians or motorists that attempt to beat the draw bridge once a blinking red light, such as on a computer display 210 of signs 320 and 322, is activated at both entrances 300*a* and 300*b* of the draw bridge apparatus 301. The first camera, for example of sign 320 is about eye level (such as four to five feet above the ground), and the second camera, may be about ankle level (such as about one to two feet above the ground). The function of the first or camera located at a greater height, attached to the sign 320, is to capture the facial appearance of any vehicle operator that tries to rush and beat the activation of the drawbridge after a blinking red alert light indicates the drawbridge has been activated. The function of the second camera or lower height camera on the sign 320 is to capture a vehicle's license plate number.

The sections 302 and 304 of the drawbridge 301, may be embedded with a temperature sensor and wireless transmitter/transmitters 310*a* and 310*b* shown in FIG. 4, which may transmit one or more signals to the signs 320 and/or 322, indicating the temperature of the section 302. The components 310*a* and 310*b* may also include one or more of the components of the warning device 200 shown in FIG. 3. When the temperature of the section 302 or 304 goes below a threshold, such as forty degrees Fahrenheit, the temperature sensor and wireless transmitters 310*a* and 310*b*, respectively, may produce signals and/or data, which is received at a wireless transmitter/receiver 212 of the signs 320 and 322, and a computer processor 206 of each of the signs 320 may be programmed by computer software stored in computer memory 202 to produce an audio message from an audio speaker 214, of each of the signs 320 and 322 which states "please slow down and drive very carefully while the bridge because the bridge freezes faster than non bridge roads".

In at least one embodiment, dashboard apparatus 1, the scanner 8, camera 10, and/or wireless transmitter/receiver 14 may receive one or more signals or information indicating that there is a snowy or icy condition on a bridge coming up, such as from temperature sensor and wireless transmitters 310*a* and/or 310*b* embedded in bridge sections 302 and 304, respectively, or that the vehicle on which dashboard apparatus 1 is located on a bridge with a snowy or icy condition.

Figure 6:
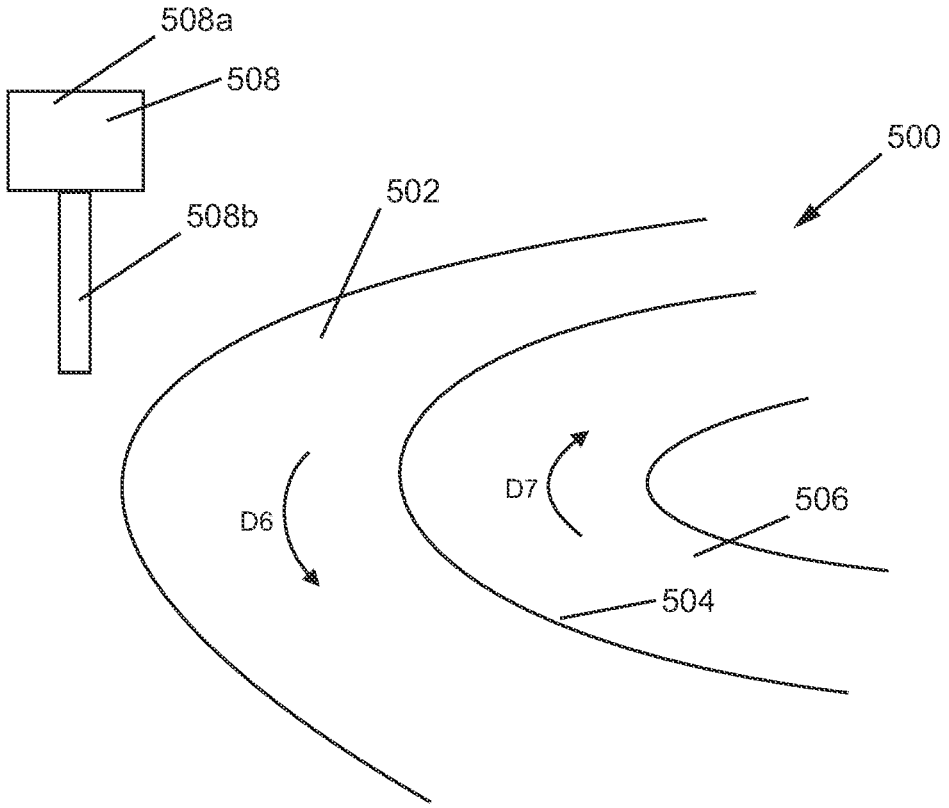
FIG. 6 shows a simplified diagram of a road that has a sharp curve, with a sign or stand fixed at the location of the sharp curve.

The scanner 8, camera 10, and/or wireless transmitter/receiver 14 may receive one or more signals or information indicating that there is a sharp curve coming up, or that the vehicle on which dashboard apparatus 1 is located is in a sharp curve, such as sharp curve or sharp curved road 500 shown of FIG. 6. The sharp curved road 506 may have a center line 504, a right lane 506 and a left lane 502. The flow of traffic on right lane 506 is in the direction D7, while the flow of traffic in the left lane 502 is in the direction D6.

In at least one embodiment, as a vehicle with dashboard apparatus 1 approaches the sharp curved road 500, from either direction D6 or D7, the scanner 8, camera 10, and/or wireless transmitter/receiver 14 may determine that there is a sharp curve coming up or the vehicle is in a sharp curve by a stationary sign or stand 508 located at the sharp curved road 506, shown in FIG. 6.

Upon the computer processor 4 determining that there is a sharp curve or sharp curved road portion 506 coming up or that the vehicle is in a sharp curve, a pre-recorded audio message will be played by the computer processor 4 of the dashboard apparatus 1 through the audio speaker 16 as determined by computer software stored in the computer memory 2, to the effect of: "you are approaching a sharp curve, please slow down, no speeding and do not attempt to overtake any vehicle on a sharp curve because this may result in a head on collision with a vehicle coming from the opposite side" of the street.

The sign or stand 508 may have a portion 508*a* and a post portion 508*b*, which is planted or secured into a ground surface, such as by concrete. The sign or stand 508 may include one or more of the components of the warning device 200 of FIG. 3.

Figure 7:
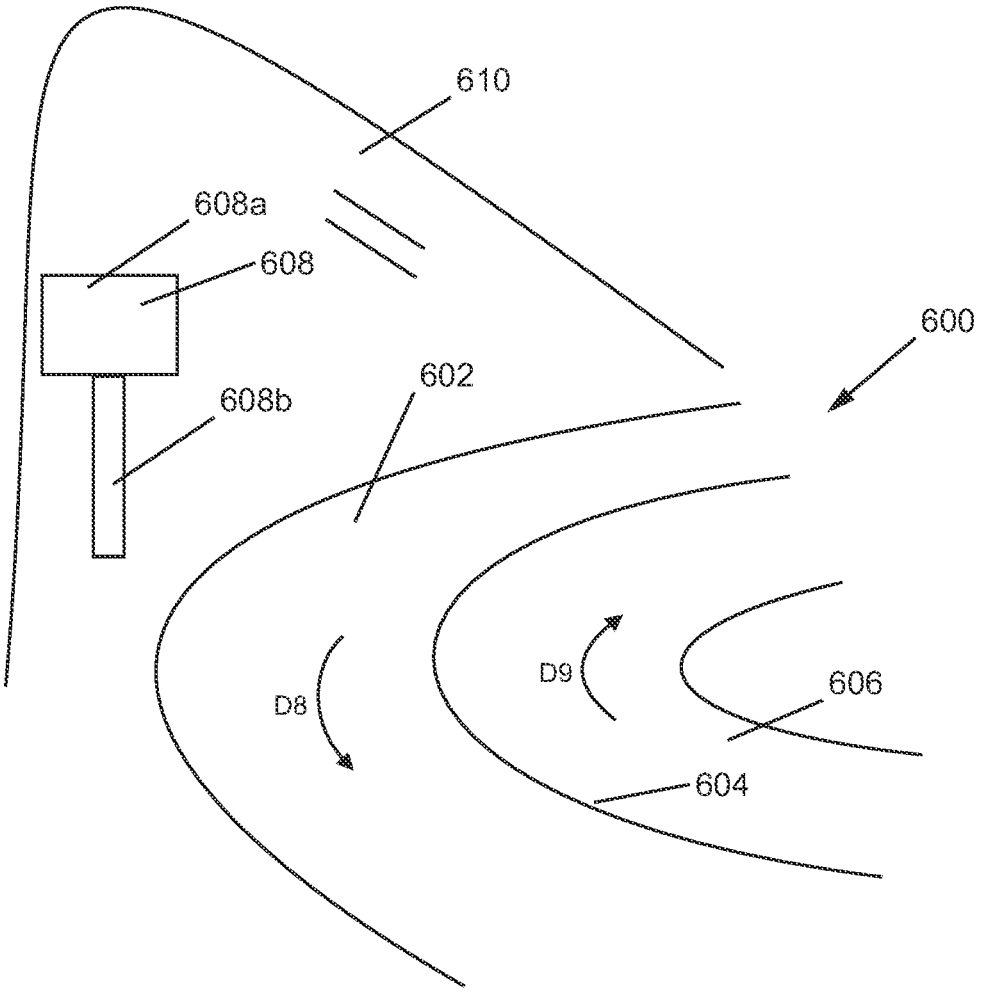
FIG. 7 shows a simplified diagram of a road that has a mountain or elevated region next to it, which is prone to have rocks falling on the road from the elevated region of FIG. 7, with a sign or stand fixed at the location.

In at least one embodiment, a rock falling warning device, sign or stand 608 is provided as shown in FIG. 7. The sign or stand 608 includes portion 608*a* and post portion 608*b*, which is planted or secured into a ground surface, such as by concrete. The sign or stand 608 may include one or more of the components of the warning device 200 of FIG. 3.

The scanner 8, camera 10, and/or wireless transmitter receiver 14 may receive one or more signals and/or information from the sign or stand 608 indicating that rocks are falling in front of a vehicle that has the dashboard apparatus 1. In at least one embodiment, the stationary stand or sign 608 is located at the base of a mountain, hill, or elevated region 610, as shown in FIG. 7, which is prone to falling rocks. The stand or sign 608 may include a scanner, in addition to or as part of warning device 200, for determining if rocks are falling from the hill, mountain, or elevated region 610. The stand or sign 608 may include a wireless transmitter/receiver, such as wireless transmitter/receiver 212 shown in FIG. 3, which is configured to provide one or more signals to the scanner 8, the camera 10, and/or the wireless transmitter receiver 14 of the dashboard apparatus 1.

In at least one embodiment, a vehicle having the vehicle dashboard 1, approaches the stationary stand 608, from either direction D8 or direction D9, shown in FIG. 7 and the vehicle's dashboard apparatus 1, after receiving one or more signals from the stand or sign 608, is configured, via computer processor 4, to provide a pre-recorded audio message through speaker 16, as programmed by computer memory 2 will be activated to say something like to the vehicle operator "you are approaching an area that is prone to falling rocks, please watch out or look out for any possible falling rock while you are driving in this area and be prepared to respond promptly to prevent any accident." Audio messages may also be provided by the sign or stand 608, through its own audio speaker 214, after detecting the presence of a vehicle (having apparatus 1 or not having apparatus 1), via signals and/or data provided by camera(s) 204, wireless transmitter/receiver 212, or scanner 205.

Figure 8:
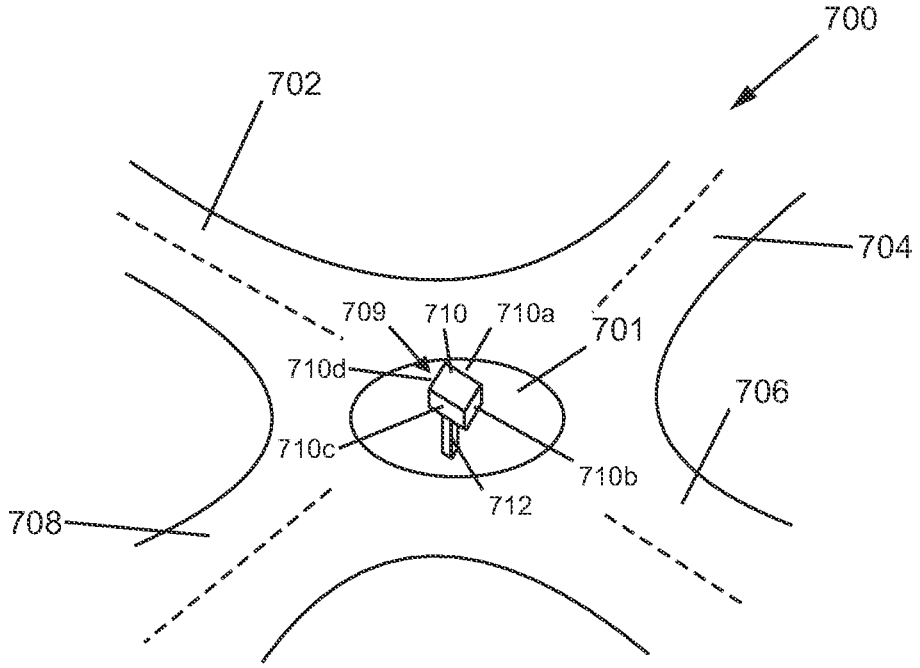
FIG. 8 shows a simplified diagram of a four way intersection, with a sign or stand fixed at each entrance of the four-way intersection.

FIG. 8 shows a diagram of a simplified diagram of a four way traffic intersection 700, with a sign or stand 709 fixed by a post 712 into the ground, such as by concrete, to a center 701 or substantially the center of the four way traffic intersection 700.

In at least one embodiment, the sign or stand 709 includes a portion 710 which has four segments 710*a*, 710*b*, 710*c*, and 710*d*. Each of the segments 710*a*, 710*b*, 710*c*, and 710*d* has a camera, which may be one of camera(s) 204 of the warning device 200, facing one of four roads leading to the center 701 of the four-way intersection 700. Segment 710*a* has a camera facing towards road 704, segment 710*b* has a camera facing towards road 706, segment 710*c* has a camera facing towards road 708, and segment 710*d* has a camera facing towards road 702.

When a vehicle, having dashboard apparatus 1, approaches the center 701 of the four way intersection 700 from one of the roads 702, 704, 706, and 708, one or more signals or other information will be provided from sign or stand 709 to one or more of the scanner 8, the camera 10, and/or the wireless transmitter receiver 14 of the dashboard apparatus 1. In response to these signals and/or information, the computer processor 4 will cause a pre-recorded message to be played by the audio speaker 16, in accordance with a message stored in computer memory 2. The audio message may be something to the effect of "now you are at a dangerous intersection, please make sure there is no oncoming and/or approaching vehicles, pedestrians and/or motorcycles in the dangerous intersection. If there are approaching vehicles, pedestrians and or motorcyclist, please yield to them and then proceed very carefully pass the dangerous intersection."

In addition, the sign or stand 709 may include one or all of the components of the warning device 200, and the sign or stand 709 may provide its own audio warning messages or information through audio speaker 214 and/or video warning messages or information through computer display 210. In at least one embodiment, each segment of the segments 710*a*, 710*b*, 710*c*, and 710*d* may have its own warning device 200, such that up to four video displays with video display warnings may be provided, and up to four audio warnings may be provided which are directed towards the road that the particular segment is directed. These four video and audio warnings may be completely independent of on another.

Figure 9:
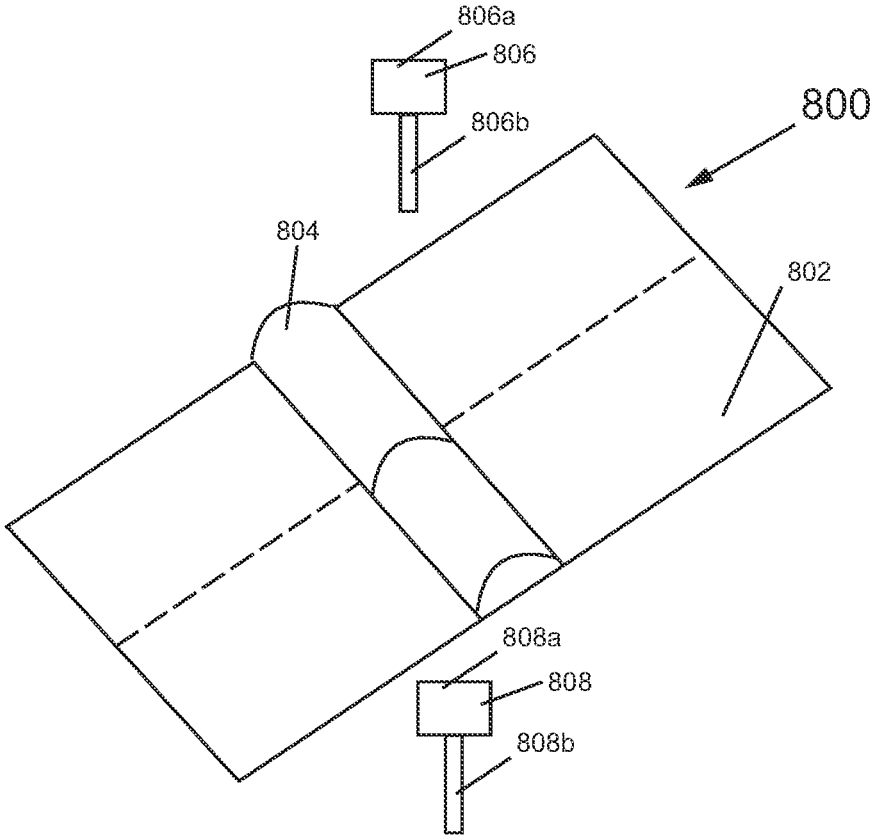
FIG. 9 shows a simplified diagram of a speed bump or hump on a road with signs or stands fixed on either side of the road

FIG. 9 shows a simplified diagram 800 of a road 802 and a speed bump or hump 804 going across the road 802. Also shown are signs or stands 806 and 808 typically located on the right side (for United States roads), before the speed bump 804. The sign or stand 806 includes portion 806*a* and post portion 806*b*, which is planted or secured into a ground surface, such as by concrete. The sign or stand 806 may include one or more of the components of the warning device 200 of FIG. 3. Similarly or identically, the sign or stand 808 includes portion 808*a* and post portion 808*b*, which is planted or secured into a ground surface, such as by concrete. The sign or stand 808 may include one or more of the components of the warning device 200 of FIG. 3.

The scanner 8, camera 10, and/or wireless transmitter/receiver 14 may receive one or more signals or information from the one or more speed bump warning sign(s) 806 and 808, and in response the computer processor 4 may provide a prerecorded message from the audio speaker 16 to the effect of "You are approaching a speed bump barrier, pleased slow down as much as possible to prevent any damages to your vehicle." Each of the warning signs 806 and 808 may include digital displays or monitors, similar or identical to computer display 210 shown in FIG. 3, for providing visual warnings to drivers, and also wireless transmitter/receivers, similar or identical to wireless transmitter/receivers 212 for providing one or more signals to be received by the scanner 8, camera 10, and/or wireless transmitter receiver 14 of the dashboard apparatus 1. The signs 806 and 808 are anchored into the ground next to the road 802.

Each of the signs or stand 806 and 808 may include one or all of the components of the warning device 200, and each of the signs or stand 806 and 808 may provide its own audio warning messages or information through audio speaker 214 and/or video warning messages or information through computer display 210.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:
a first sign comprised of:
a first camera fixed to the first sign;
a second camera fixed to the first sign;
wherein the first camera is fixed to the first sign at a first height and the second camera is fixed to the first sign at a second height which is different from the first height, so that the first camera is configured to take a photograph of a person driving a vehicle, while the second camera is configured to take a photograph of a license plate of a vehicle; and
wherein the first sign includes a remote control deactivation device configured to deactivate an engine of a vehicle approaching the sign, when a predetermined condition occurs.

2. The apparatus of claim 1
the first sign is further comprised of a post; and
wherein the first camera is fixed at the first height on the post of the first sign; and
wherein the second camera is fixed at a second height on the post of the first sign.

3. The apparatus of claim 1
wherein the first sign is configured to be located at a street, and the first sign includes a portion which shows a message concerning a characteristic of the street.

4. The apparatus of claim 1
wherein the predetermined condition is that the vehicle is within a certain distance of the first sign.

5. The apparatus of claim 1
further comprising a second sign;
wherein the second sign includes a warning device;
wherein the warning device includes:
a computer processor;
a computer memory; and
an audio speaker;
wherein the computer processor is configured to cause a first audio warning to be played on the audio speaker in response to computer programming stored in the computer memory when there is a dangerous road condition.

6. The apparatus of claim 5
wherein the first sign is configured to be located at a street, and the first sign includes a portion which shows a message concerning a characteristic of the street; and
wherein the second sign is configured to be located at the street, and the second sign includes a portion which shows the message concerning the characteristic of the street.

7. The apparatus of claim 5 further including:
a dashboard apparatus, configured to be fixed to a vehicle;
wherein the dashboard apparatus is configured to communicate wirelessly with the warning device concerning the dangerous road condition.

8. The apparatus of claim 5 wherein
the warning device further includes a computer display; and
wherein the computer processor is configured to cause a first visual warning to be displayed on the computer display in response to computer programming stored in the computer memory when there is a dangerous road condition.

9. An apparatus comprising:
a first sign comprised of:
a first camera fixed to the first sign;
a second camera fixed to the first sign;
wherein the first camera is fixed to the first sign at a first height and the second camera is fixed to the first sign at a second height which is different from the first height, so that the first camera is configured to take a photograph of a person driving a vehicle, while the second camera is configured to take a photograph of a license plate of a vehicle;
further comprising a second sign;
wherein the second sign includes a warning device;
wherein the warning device includes:
a computer processor;
a computer memory; and
an audio speaker;
wherein the computer processor is configured to cause a first audio warning to be played on the audio speaker in response to computer programming stored in the computer memory when there is a dangerous road condition;
wherein the first sign includes a remote control deactivation device configured to deactivate an engine of a vehicle approaching the sign, when a predetermined condition occurs;
wherein the apparatus further includes a dashboard apparatus fixed to the vehicle;
and wherein the dashboard apparatus is configured to communicate with the warning device of the second sign.

10. A method comprising
fixing a first camera to a first sign;
fixing a second camera to the first sign; and fixing the first sign at a vehicular traffic location;

wherein the first camera is fixed to the first sign at a first height and the second camera is fixed to the first sign at a second height which is different from the first height, so that the first camera is configured to take a photograph of a person driving a vehicle, while the second camera is configured to take a photograph of a license plate of a vehicle; and wherein the first sign includes a remote control deactivation device configured to deactivate an engine of a vehicle approaching the sign, when a predetermined condition occurs.

11. The method of claim 10 wherein the first sign is further comprised of a post; and wherein the first camera is fixed at the first height on the post of the first sign; and wherein the second camera is fixed at a second height on the post of the first sign.

12. The method of claim 10 wherein is fixed at a street; and the first sign includes a portion which shows a message concerning a characteristic of the street.

13. The method of claim 10 wherein the predetermined condition is that the vehicle is within a certain distance of the first sign.

14. A method comprising fixing a first camera to a first sign;

fixing a second camera to the first sign; and fixing the first sign at a vehicular traffic location;

wherein the first camera is fixed to the first sign at a first height and the second camera is fixed to the first sign at a second height which is different from the first height, so that the first camera is configured to take a photograph of a person driving a vehicle, while the second camera is configured to take a photograph of a license plate of a vehicle;

wherein the first sign is fixed at a street; and further comprising fixing a second sign at a location which is spaced apart along the street from where the first sign is fixed;

wherein the second sign includes a warning device;

wherein the warning device includes:

a computer processor;

a computer memory; and an audio speaker;

wherein the computer processor is configured to cause a first audio warning to be played on the audio speaker in response to computer programming stored in the computer memory when there is a dangerous road condition;

and wherein the first camera and the second camera of the first sign face in the direction of the second sign, so that when a particular vehicle approaches the second sign and then travels from the second sign to the first sign, the first audio warning will be played on the audio speaker of the second sign before a photograph is taken of the person driving the particular vehicle by the first camera of the first sign or of the license plate of the particular vehicle by the second camera of the first sign.

15. The method of claim 14 wherein the first sign is configured to be located at a street, and the first sign includes a portion which shows a message concerning a characteristic of the street; and wherein the second sign is configured to be located at the street, and the second sign includes a portion which shows the message concerning the characteristic of the street.

16. The method of claim 14 wherein the first sign includes a remote control deactivation device configured to deactivate an engine of a vehicle approaching the sign, when a predetermined condition occurs;

wherein the apparatus further includes a dashboard apparatus fixed to the vehicle;

and wherein the dashboard apparatus is configured to communicate with the warning device of the second sign.

17. The method of claim 14 further comprising fixing a dashboard apparatus to a vehicle;

wherein the dashboard apparatus is configured to communicate wirelessly with the warning device concerning the dangerous road condition.

18. The method of claim 14 wherein the warning device further includes a computer display; and and wherein the computer processor is configured to cause a first visual warning to be displayed on the computer display in response to computer programming stored in the computer memory when there is a dangerous road condition.

* * * * *